US005435284A

United States Patent [19]

Shimizu et al.

[11] Patent Number: 5,435,284

[45] Date of Patent: Jul. 25, 1995

[54] THROTTLE CONTROL APPARATUS

[75] Inventors: Masaru Shimizu, Shitamachi; Masaharu Hayashi, Wakabayashihigashimachi; Mitsuo Kikkawa, Minamiyochi, all of Japan; Shoichi Doi, Ann Arbor, Mich.; Yoshifumi Yamada, Murakami, Japan; Shinichiro Tanaka, West Hartford, Conn.; Ichiro Hosotani, Numazu, Japan

[73] Assignee: Aisin Seiki Kabushiki Kaisha, Kariya, Japan

[21] Appl. No.: 144,433

[22] Filed: Nov. 2, 1993

[30] Foreign Application Priority Data

Nov. 3, 1992 [JP] Japan ..... 4-334860

[51] Int. Cl.[6] ..... F02D 7/00

[52] U.S. Cl. ..... 123/396

[58] Field of Search ..... 123/396, 399, 400, 403

[56] References Cited

U.S. PATENT DOCUMENTS

| | | | |
|---|---|---|---|
| 4,873,957 | 10/1989 | Ueyama et al. | 123/396 |
| 4,892,071 | 1/1990 | Asayama | 123/396 |
| 4,895,343 | 1/1990 | Sato | 123/396 |
| 5,163,402 | 11/1992 | Taguchi et al. | 123/396 |
| 5,297,521 | 3/1994 | Sasaki et al. | 123/396 |

FOREIGN PATENT DOCUMENTS

| | | | |
|---|---|---|---|
| 58-155255 | 9/1983 | Japan | 123/396 |
| 61-89940 | 5/1986 | Japan | 123/396 |

*Primary Examiner*—Raymond A. Nelli

*Attorney, Agent, or Firm*—Burns, Doane, Swecker & Mathis

[57] ABSTRACT

A throttle control apparatus includes a throttle opening adjusting device for regulating the throttle valve opening in such a manner that the throttle valve is located in a first position for assuring sufficient opening of the throttle valve upon ignition, with the throttle valve being rotatable after establishment of ignition or combustion. The throttle valve is then moved to a second position located between the first position and a fully closed position upon an electric failure.

13 Claims, 4 Drawing Sheets

THROTTLE CONTROL APPARATUS

FIELD OF THE INVENTION

The present invention relates to a throttle control apparatus and in particular to a throttle control apparatus in which the opening of the throttle valve is varied in response to the amount of operation of an accelerator operation mechanism.

BACKGROUND OF THE INVENTION

Conventional throttle control apparatus are disclosed in Japanese Patent Laid-open Print Nos. 58(1983)-155255 and 61(1986)-89940. In these conventional apparatus, an electric controller is associated with an accelerator operation mechanism and the amount of operation thereof is fed to the controller. From the controller, the resultant operational amount, as a signal, is fed to a motor for adjusting an opening of a throttle valve. The throttle valve is urged toward its fully closed condition by a return spring. Thus, the motor driving for adjusting the opening of the throttle valve is established against the urging force of the return spring.

However, in the conventional throttle control apparatus, when an electric failure occurs, the function of the motor ceases, resulting in the throttle valve being brought into its fully closed condition. Thus, an engine stall will occur while the engine runs, or an ignition of the engine cannot be established when the engine is about to be initiated.

SUMMARY OF THE INVENTION

It is, therefore, a primary object of the present invention to provide a throttle control apparatus without the foregoing drawback.

It is another object of the present invention to provide a throttle control apparatus which assures the prevention of an engine stall or the establishment of ignition.

In order to attain the foregoing objects, a throttle control apparatus of an accelerator operation mechanism is comprised of: a throttle shaft which fixes fixing a throttle valve of an internal combustion engine thereto and supported on a housing so as to be able to rotate; a motor; an electromagnetic clutch for connecting the throttle shaft and one of the motor and the accelerator operation mechanism; a return spring urging the throttle valve toward its fully closed position; electric control means for controlling the motor and the electromagnetic clutch in such a manner that when the motor is connected to the throttle valve the motor is so controlled as to establish a throttle opening which is in response to an operation amount of the accelerator operation mechanism, when the accelerator operation mechanism is released the motor is so controlled as to establish a constant idling of the engine, and when an electric trouble occurs, the throttle shaft is directly connected to the accelerator operation mechanism; and throttle opening adjusting means for regulating an opening of the throttle valve in such a manner that the throttle valve assumes a first position for assuring sufficient opening of the throttle valve upon ignition, after establishment of ignition, the throttle valve is permitted to be rotatable between the first position and the fully closed position, and assumes a second position locating the first position and the fully closed position upon an electric failure.

BRIEF DESCRIPTION OF THE DRAWINGS

The above and other objects, features and advantages of the present invention will be more apparent and more readily appreciated from the following detailed description of a preferred exemplary embodiment of the present invention, taken in connection with the accompanying drawings, in which.

DESCRIPTION OF THE PREFERRED EMBODIMENT

An embodiment of the present invention will be described below in detail with reference to the accompanying drawings.

Figure 1:
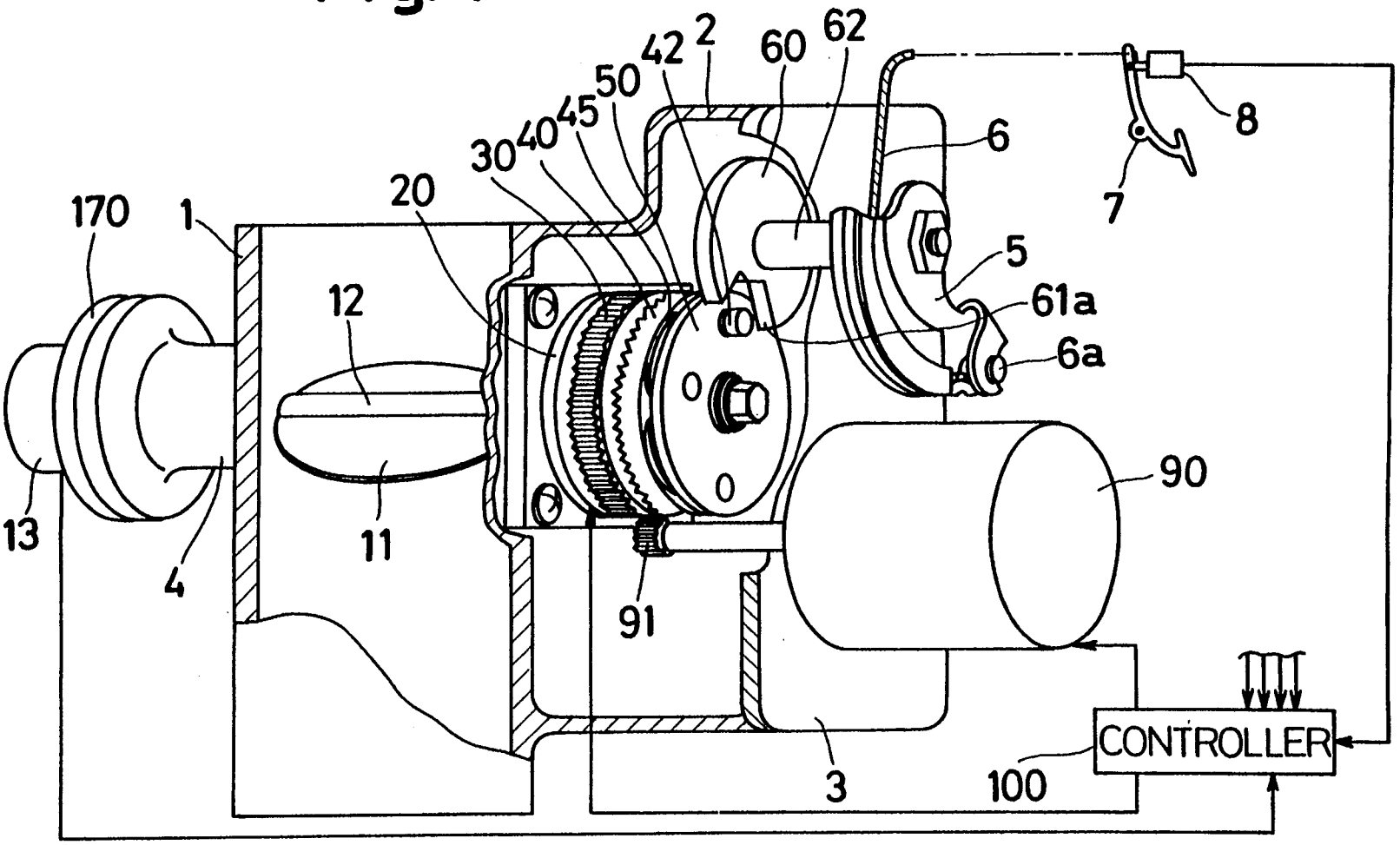
FIG. 1 is a perspective view of an embodiment of a throttle control apparatus according to the present invention.
Figure 2:
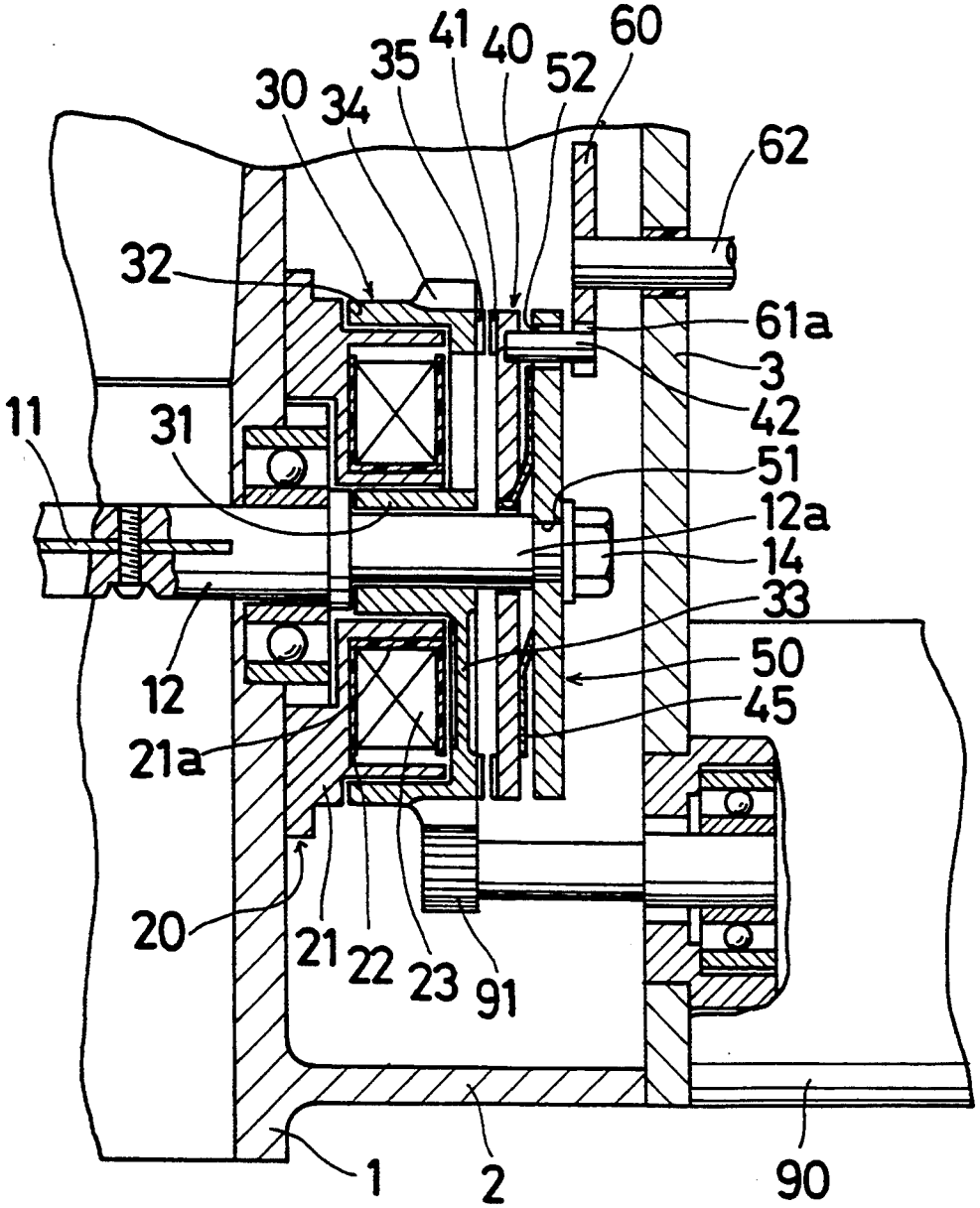
FIG. 2 is a cross-sectional view of a portion around an electromagnetic clutch of a throttle control apparatus shown in FIG. 1.
Figure 3:
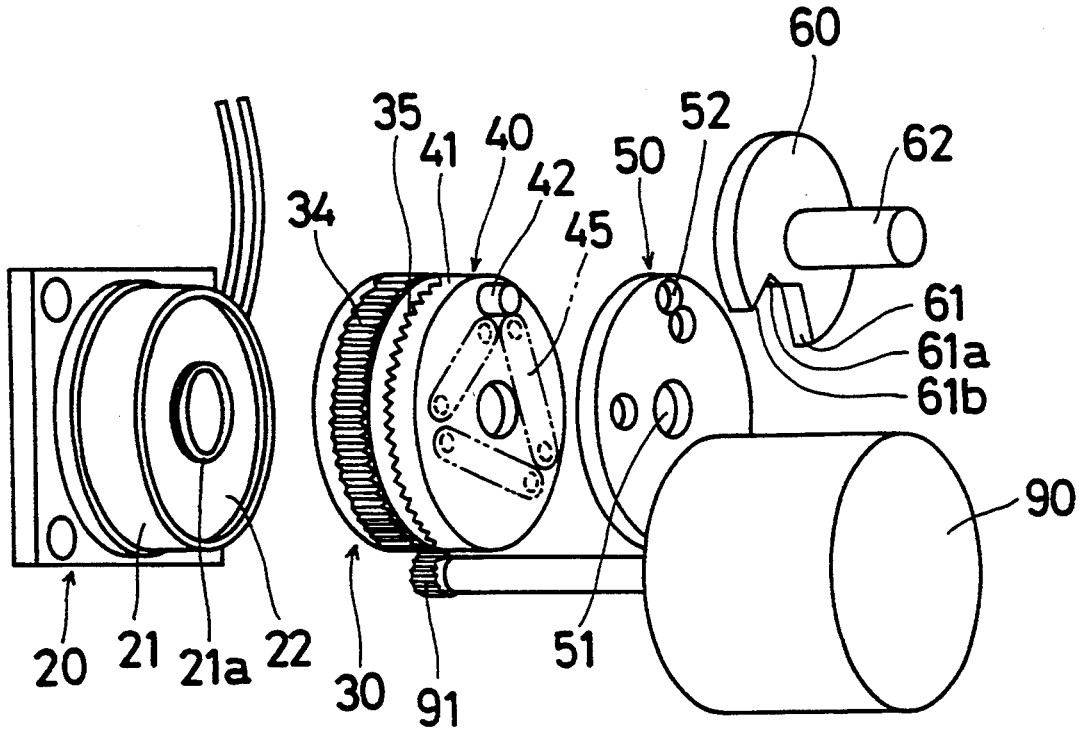
FIG. 3 is an exploded perspective view of a portion around an electromagnetic clutch of a throttle control apparatus shown in FIG. 1.

Referring first to FIGS. 1 through 3, a throttle valve 11 is disposed in a housing 1 which forms or constitutes an intake air passage of an internal combustion engine (not shown). The throttle valve 11 is fixed to a throttle shaft 12 which is rotatably supported on the housing 1. One end of the throttle shaft 12 extends from a side of the housing 1 to the outside. At the side of the housing 1 which extends around an extending portion 12*a*, a case 2 is formed in a body and a cover 3 is united or integrated with the case 2. On the other hand, at a side of the housing 1 disposed opposite to the case 2 and on which the other end of the throttle shaft 12 is supported, a cylindrical support 4 is formed on the housing 1 in a body. In the support 4, a throttle opening adjusting device 170 which will be detailed later and a throttle sensor 13 are provided.

The throttle sensor 13 is connected at the top end of the throttle shaft 12. This throttle sensor 13 transforms rotational displacements into electric signals. The throttle sensor 13 is expected to feed the electric signals to a controller 100 in response to the amount of opening of the throttle valve 11. The controller 100 is in the form of a CPU or a micro-processor. Furthermore, the throttle sensor 13 is also expected to feed a signal indicating the opening and closing condition of the throttle valve 11.

An electromagnetic coil 20 is fixed to the side of the housing 1 so as to surround a base portion 12*a* of the throttle shaft 12. The electromagnetic coil 20 is provided with a yoke 21 which is made of a magnetic substance and a bobbin 22 which is made of resin as shown in FIGS. 1 and 2. The yoke 21 is provided with a cylindrical portion 21*a* at its center. Around this cylindrical portion 21*a*, a circular portion is formed on the yoke 21, and the yoke 21 and a coil 23 are disposed in the circular portion. A bottom portion of the yoke 21 is fixed to the side of the throttle shaft 12 which penetrates into the cylindrical portion 21*a*.

Moreover, a rotor 30 which is made of a magnetic substance is supported on the extending portion 12*a* of the throttle shaft 12 so as to be able to rotate. The rotor 30 is disposed in a prescribed portion which is opposite the yoke 21 and is held so as not to be able to move in the direction of the axis of the throttle shaft 12. As shown in FIG. 2, the rotor 30 is made of a sintered metal using mainly iron and has a shape comprised of a cylindrical portion 32 connected with an axial portion 31 that is supported on the throttle shaft 12 via arm portions 33. The axial portion 31 of the rotor 30 is fitted into the cylindrical portion 21*a* of the yoke 21 with a predetermined gap so as to overlap in the axial direction and the cylindrical portion 32*a* of the rotor 32 surrounds the outer side of the yoke 21. At an outer circumferential side of the cylindrical portion 32 of the rotor 30, outer teeth 34 are formed in a body. Furthermore, at a flat portion adjacent to the outer teeth, as shown in FIGS. 2 and 3, nail portions 35 which have a triangular cross-sectional shape are continuously arranged on the whole circumference. The nail portions 35 extend radially and possess a wavy form.

In addition, a clutch plate 40 which is of a disk shape is supported on the throttle shaft 12 so as to confront the rotor 30. The clutch plate 40 is able to move in the axial direction. The clutch plate 40 is made of a magnetic substance and is provided with nail portions 41 which have the same triangular cross-sectional shape as the nail portions 35 and which are formed on the whole circumference of its own flat portion opposite to the nail portions 35 so as to radially extend like the nail portions 35. The nail portions 41 can be formed by not only mechanism or electrospark machining but also can be formed by pressing. The electromagnetic coil 20, the rotor 30, and the clutch plate 40 constitute an electromagnetic clutch mechanism.

A pin 42 is fixed to a face of the clutch plate 40 which is located opposite the face having the second nail portions 41. Furthermore, at this face of the clutch plate 40, one of the ends of the sheet springs 45 which are shown by a chain line in FIG. 3 are fixed thereto by pins (not shown). On the other hand, the other ends of the sheet springs 45 are fixed to a plate holder 50 by pins (not shown). Accordingly, the clutch plate 40 is connected with the plate holder 50 via the sheer springs 45. If one of the pins for fixing the sheet springs 45 is extended and is used as the common pin 42, it is possible to reduce the number of parts.

At the top end portion of the extending portion 12*a* of the throttle shaft 12, the plate holder 50 is fixed thereto. The plate holder 50 is provided with an oval hole 51 which is formed at its center. On the other hand, the top end of the extending portion 12*a* of the throttle shaft 12 is formed so as to be the same cross-sectional shape as the hole 51 and is fitted into the hole 51. Thereby, the plate holder 50 is restrained from rotating with regard to the throttle shaft 12. The top end portion of the extending portion 12 has a length that is the same as the thickness of the plate holder 50. A bolt (or a nut) 14 is screwed down on the top end surface of the extending surface of the extending portion 12*a* and thereby the plate holder 50 is nipped between the bolt (or the nut) 14 and a step portion which is formed at a base portion of the top end portion of the extending portion 12*a*. The hole 51 and the top end portion of the extending portion 12*a* may have, for example, a semi-circular sectional shape and can be formed to have various shapes which restrain the plate holder 50 from rotating with regard to the throttle shaft 12.

The plate holder 50 is further provided with a hole 52 and several other holes. The hole 52 is formed at the outer edge portion of the plate holder 50 and a pin 42 is penetrated into and extends through the hole 52. The holes are formed for caulking the sheer springs 45. Thus, when the plate holder 50 is fixed to the throttle shaft 12, a top end of the pin 42 projects from the hole 52 of the plate holder 50 as shown in FIGS. 1 and 2.

Furthermore, an operation plate 60 is disposed around the pin 42 which is fixed to the clutch plate 40 so as to be opposite to the plate holder 50 at its outer edge portion. An acceleration shaft 62 is fixed to a center portion of the plate 60 and is supported by the cover 3 in a nearly parallel arrangement with the throttle shaft 12 so as to be able to rotate. The operation plate 60 is restrained from moving in the axial direction. The operation plate 60 is provided with a notch 61 which is formed at its outer edge portion so as to overlap with the pin 42. The operation plate 60 is arranged so that at least one of the radial surfaces 61*a* and 61*b* can contact the side of the pin 42 in response to the rotation of the operation plate 60 in the nonexciting condition of the electromagnetic coil 20.

The other end of the accelerator shaft 62 is connected with an accelerator plate 5 shown in FIG. 1 by a bolt or a nut, and a cable end 6*a* which is formed on one end of an accelerator cable 6 is engaged with an outer edge portion of the accelerator plate 5. The other end of the accelerator cable 6 is connected with an accelerator 7 in order that the operation plate 60 is rotated about an axial center of the accelerator shaft 62 in response to the depression of the accelerator 7. A well-known accelerator sensor 8 is installed on the accelerator 7. This accelerator sensor 8 feeds an indication of the degree of depression of the accelerator 7, as electric signals, to the controller 100.

A motor 90 which serves as a driving source is fixed to the cover 3 and a rotation shaft of the motor 90 is supported in parallel arrangement with the throttle shaft 12 so as to be able to rotate. A pinion gear 91 is fixed at a top end of the rotation shaft of the motor 90, and this pinion gear 91 is engaged with the outer teeth 34 of the rotor 30. In this embodiment, a stepping motor is employed as the motor 90 and is under the control of the controller 100. Other types of motors such as a DC motor can be used as the motor 90.

When the motor 90 is turned on and the pinion gear 91 is rotated, the rotor 30 having the outer teeth 34 which are engaged with the pinion gear 91 is rotated around the throttle shaft 12. In this situation, if the electromagnetic coil 20 is in its nonexciting condition, the clutch plate 40 is separated from the rotor 30 by the urging force of the sheet springs 45 and is located in the adjacent position to the plate holder 50. Namely, the clutch plate 40, the plate holder 50 and the throttle valve 11 can be freely rotated by the throttle shaft 12 regardless of the condition of the rotor 30. In this situation, the pin 42 which is fixed to the clutch plate 40 is located between both surfaces 61*a* and 61*b* of the notch 61 of the operation plate 60.

When the electromagnetic coil 20 is excited, a closed magnetic circuit is formed by the yoke 21, the rotor 30 and the clutch plate 40. Thereby, the clutch plate 40 is attracted toward the rotor 30 against the urging force of the sheet spring 45 by an electromagnetic force and the nail portions 35 of the rotor 30 and the nail portions 41 of the clutch plate 40 are engaged with each other. Namely, the rotor 30 and the clutch plate 40 assume an engaging condition and are able to rotate in a body. Thereby, the controlled variable driving operation of the motor 90 is transmitted from the pinion gear 91 to the rotor 30 via the outer teeth 34 and next is transmitted to the clutch plate 40 via the nail portions 35 and the nail portions 41. Furthermore, the controlled variable driving is transmitted from the clutch plate 40 to the plate holder 50 via the sheet springs 45 and therefore is transmitted to the throttle shaft 12 which rotates with the plate holder 50 in a body. As a result, the amount of opening of the throttle valve 12 is controlled in response to the above driving controlled variable. In this situation, since the pin 42 moves with the clutch plate 40 toward the rotor 30 and does not locate between both surfaces 61*a* and 61*b* of the notch 61 of the operation plate 60, the operation plate 60 is rotated regardless of the condition of the pin 42.

The electromagnetic coil 20 is controlled by the controller 100 to which various signals are fed from sensors (some of them are not shown) so as to be excited and non-excited in response to the driving condition of the vehicle. Furthermore, the driving of the motor 9 is controlled by the controller 100 so as to be able to obtain the amount of opening of the throttle valve 11 which is determined in response to the amount of depression of the accelerator 7, namely the accelerator operational amount and various control conditions.

In the foregoing structure, when the motor 90 is connected to the throttle valve 1, the controller 100 controls the opening of the throttle valve 1 so as to be in response to the degree of depression or the operation amount of the accelerator 7. When the accelerator 7 is released, the motor 90 is controlled by the controller 100 so as to establish a constant idling of the engine.

Figure 4:
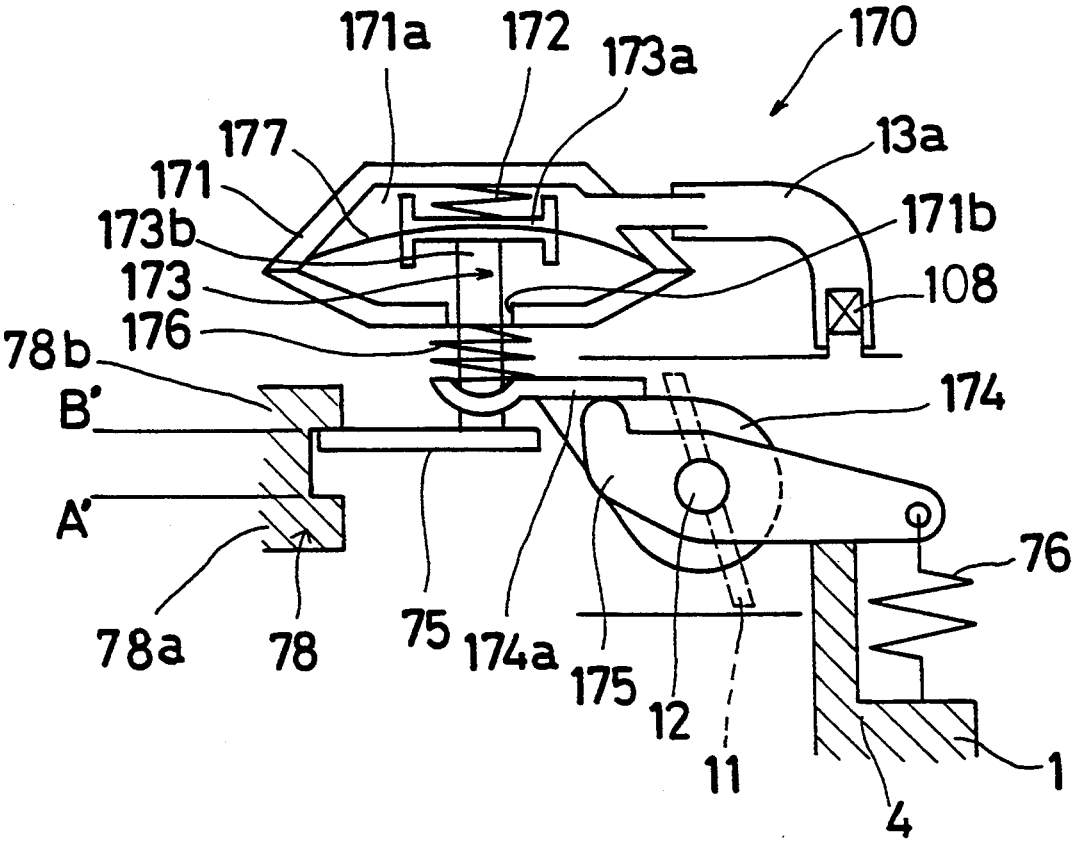
FIG. 4 is a cross-sectional view of a throttle opening adjusting device of a throttle control apparatus shown in FIG. 1.

Referring to FIG. 4, a throttle opening adjusting device 170 includes an actuator 171 having an inner space in which a first chamber 171*a* and a second chamber 171*b* are defined by a diaphragm 177. The first chamber 171*a* is in fluid communication with the downstream end of the housing 1 through a conduit 13*a* in which a pressure transmission delay device 108 is provided in order that the electromagnetic clutch can be brought into its engaged condition prior to the actuation of the throttle opening adjusting device 170. This enables the prevention of an engine stall immediately upon initiation thereof. The second chamber 171*b* is kept at atmospheric pressure. In the first chamber 171*a*, there is disposed a first spring 172 for urging a base portion 173*a* of a moving member 173 toward the second chamber 171*b*. From the base portion 173*a* to which is secured the diaphragm 177, a shaft portion 173*b* extends. The shaft portion 173*b* extends outside the base portion 173*a* and passes through a distal end portion 174*a* of a plate 174. A distal end of the shaft portion 173*b* is secured to a regulating member 75 so as to be perpendicular thereto. The plate 174 is rotatably mounted on the throttle shaft 12. A spring 176 is disposed between the actuator 171 and the plate 174. A throttle lever 175 is secured to the throttle shaft 12. Between the housing 1 and a right end portion of throttle lever 175, there is disposed the return spring 76 so as to rotate the throttle valve 11 towards its closed condition. A left end of the throttle lever 175 is in abutment with the plate 174. The spring load of the spring 176 is greater than the spring load of the return spring 76, which results in the distal end 174*a* of the plate 174 being in engagement with the regulating member 75. This enables a unitary movement of the moving member 173, the regulating member 75 and the plate 174. As a whole, the plate 174 is applied with a downward force which is the sum of the load of the spring 172 and the spring 176 and is applied with an upward force which is the sum of the load of the spring 76 and the negative pressure. While the engine runs after its ignition, the regulating member 75 is engaged with an upper stopper portion 78*b* of a part 78 of the cylindrical support 4 and is at a position "B" which corresponds to a 2-degree opening of the throttle valve 11 as illustrated. The reason is that the sum of the load of the spring 172 and the spring 176 is overcome by the sum of the negative pressure and the load of the spring 76. Even though the electric control system encounters trouble, so long as the position of the regulating member 75 remains unchanged, an engine stall can be prevented. On the other hand, when the engine is at its ignition or before perfect explosion, no negative pressure is generated, which means that the spring 172 is expanded and the return spring 76 is overcome by the spring 176. Thereby the moving member 173, the plate 174 and the regulating member 75 are moved in the downward direction. Thus, the regulating member 75 is engaged with a lower stopper 78*a* of the part 78 of the cylindrical support 4 and is at a position "A" which corresponds to a 7-degree opening of the throttle valve 11 so that the minimum opening of the opening of the throttle valve for the ignition can be assured.

In operation, when ignition is established, the regulating member 75 is kept at the position "A" so that the opening of the throttle valve 11 is 7 degrees. If the perfect explosion is obtained, the value of the negative pressure in the conduit 13*a* exceeds a value, resulting in the diaphragm 177, the moving member 173, the plate 174 and the regulating member 75 being moved in the upward direction. Then, the regulating member 75 is transferred to the position "B" which leads to the opening of the throttle valve 11 of 2 degrees. The throttle lever 175 follows the movement of the plate 174. The resulting position of the throttle valve 11 is fixed by the motor 90 immediately upon engagement of the electromagnetic clutch.

While the engine runs, if the electric system encounters trouble, the application of the electric current to the electromagnetic coil 20 is interrupted. Thus, the rotor 30 and the clutch plate 40 are separated from each other, and the throttle valve 11 is urged toward its closed condition by the return spring 76. At this time, so long as the engine runs, the regulating member 75 is kept at the position "B" which means that the opening of the throttle valve 11 is 2 degrees. Thus, the fully closed condition of the throttle valve 11 cannot be established, which means that the stall of the engine can be prevented.

In addition, when trouble is experienced in the electric system, the pin 42 is located between both surfaces 61*a* and 61*b* of the notch 61 of the operating plate 60. The operating plate 60 is operated by the accelerator 7 and is rotated, the surface 61*a* is contacted with the side of the pin 42, and the clutch plate 40 and the plate holder 50 are rotated. Thus, a direct control of the throttle valve 12 can be established by the accelerator 7.

While this invention has been illustrated and described in accordance with a preferred embodiment, it is recognized that variations and changes may be made and equivalents employed herein without departing from the invention as set forth in the claims.

What is claimed is:

1. A throttle control apparatus for a vehicle comprising:

an accelerator pedal for being depressed by a driver;

an openable throttle valve of an internal combustion engine for controlling an output of the internal combustion engine;

mechanical controlling means for mechanically controlling the opening of the throttle valve in response to an operational amount of the accelerator pedal;

electrical controlling means for electrically controlling the opening of the throttle valve in response to the operational amount of the accelerator pedal;

coupling means for selectively coupling the throttle valve with one of the mechanical and the electrical controlling means;

fail-safe means for causing the coupling means to couple the throttle valve with the mechanical controlling means upon malfunction of the electrical controlling means; and adjusting means for adjusting the throttle valve to a first position upon starting the internal combustion engine.

2. The apparatus in claim 1, wherein the adjusting means includes:

an actuator having a first chamber connected to a negative pressure source, a second chamber under atmospheric pressure, a diaphragm disposed between the first chamber and the second chamber, and a first spring for urging the diaphragm to expand the first chamber; and a movable mechanism linked to the diaphragm and the throttle valve for opening the throttle valve in accordance with expansion of the first chamber, the throttle valve being adjusted to the first position upon expansion of the first chamber by the first spring while the internal combustion engine is stopped and substantially no negative pressure is introduced in the first chamber, and the throttle valve being adjusted to a position that is more closed than the first position as a result of the first chamber becoming contracted by negative pressure in the first chamber while the internal combustion engine is started and negative pressure is introduced in the first chamber.

3. An apparatus in accordance with claim 2, wherein the movable mechanism includes:

a throttle lever secured to the throttle valve, a return spring for urging the throttle lever to close the throttle valve, a plate contacting the throttle lever and urging the throttle lever to open the throttle valve, a second spring for urging the plate to open the throttle valve, and a limiting member for limiting the movement of the plate, the throttle valve being adjusted to the second position while the internal combustion engine is started and negative pressure is introduced into the first chamber.

4. An apparatus in accordance with claim 3, wherein the actuator includes a pressure delay device located between the first chamber and the negative pressure source.

5. The apparatus in claim 1, wherein the electrical controlling means includes a sensor for generating an electrical signal in response to the operational amount of the accelerator pedal, an electrical motor, and a controller for controlling the motor in response to the electrical signal generated by the sensor to establish a throttle opening in accordance with the operational amount of the accelerator pedal for controlling the motor so as to maintain a constant idling rotation of the internal combustion engine when the accelerator pedal is released.

6. The apparatus in claim 5, wherein the coupling means includes an electromagnetic clutch controlled by the controller for mechanically connecting the throttle valve to one of the electrical motor and the accelerator pedal, the electromagnetic clutch connecting the throttle valve to the electrical motor when the electromagnetic clutch is energized by the controller.

7. The apparatus in claim 1, including a return spring urging the throttle valve toward a fully closed position.

8. The apparatus in claim 1, wherein the adjusting means adjusts the throttle valve to a more closed position than the first position after starting the internal combustion engine.

9. The apparatus in claim 1, wherein the adjusting means adjusts the throttle valve to a second position located between the first position and a fully closed position.

10. A throttle control apparatus for a vehicle comprising:

an accelerator pedal depressable by a driver;

an openable throttle valve of an internal combustion engine for controlling an output of the internal combustion engine;

mechanical controlling means for mechanically controlling the opening of the throttle valve in response to depression of the accelerator pedal;

electrical controlling means for electrically controlling the opening of the throttle valve in response to depression of the accelerator pedal;

coupling means for selectively coupling the throttle valve with one of the mechanical controlling means and the electrical controlling means;

fail-safe means for causing the coupling means to couple the throttle valve with the mechanical controlling means upon malfunction of the electrical controlling means;

opening means linked to the throttle valve for urging the throttle valve to an open position; and a limiting member for limiting the urging of the opening means to a first position of the throttle valve.

11. The apparatus in claim 10, wherein the limiting member includes an actuator for urging the throttle valve to close in response to rotation of the internal combustion engine and a link mechanism for linking the actuator to the opening means, the actuator closing the throttle valve from the first position in response to rotation of the internal combustion engine.

12. The apparatus in claim 11, wherein the limiting member includes a stopping member for stopping the closure of the actuator at a second position which is a more closed position than the first position, the actuator closing the throttle valve to the second position while the internal combustion engine rotates.

13. The apparatus in claim 10, wherein the opening member includes a throttle lever secured to the throttle valve, a plate contacting the throttle lever and urging the throttle lever to open the throttle valve, and a spring for urging the plate to open the throttle valve.

* * * * *